US009312621B2

(12) United States Patent
Chen

(10) Patent No.: US 9,312,621 B2
(45) Date of Patent: Apr. 12, 2016

(54) COAXIAL CONNECTOR HAVING A STATIC TERMINAL AND A MOVABLE TERMINAL

(71) Applicant: HON HAI PRECISION INDUSTRY CO., LTD., New Taipei (TW)

(72) Inventor: Ming-Ching Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/278,332

(22) Filed: May 15, 2014

(65) Prior Publication Data

US 2014/0342604 A1 Nov. 20, 2014

(30) Foreign Application Priority Data

May 15, 2013 (TW) ..... 102117133 A
May 15, 2013 (TW) ..... 102208988 U

(51) Int. Cl.

| | |
|---|---|
| ***H01R 29/00*** | (2006.01) |
| ***H01R 13/03*** | (2006.01) |
| ***H01R 24/52*** | (2011.01) |
| *H01R 103/00* | (2006.01) |

(52) U.S. Cl.

CPC ..... *H01R 13/03* (2013.01); *H01R 24/525* (2013.01); *H01R 2103/00* (2013.01)

(58) Field of Classification Search

CPC ..... H01R 2103/00; H01R 13/7032; H01R 24/40; H01R 24/46; H01R 24/50; H01R 9/0518

USPC ..... 439/188, 578, 582, 63, 944, 886

See application file for complete search history.

(56) References Cited

U.S. PATENT DOCUMENTS

| | | | | |
|---|---|---|---|---|
| 6,068,492 | A * | 5/2000 | Uratani et al. | 439/63 |
| 6,554,630 | B2 * | 4/2003 | Uratani | 439/188 |
| 6,761,571 | B2 * | 7/2004 | Hida | 439/188 |
| 8,066,516 | B2 * | 11/2011 | Hoshiba et al. | 439/63 |
| 8,444,422 | B2 * | 5/2013 | Lin | 439/63 |
| 9,077,130 | B2 * | 7/2015 | Hashimoto et al. | |

FOREIGN PATENT DOCUMENTS

| | | |
|---|---|---|
| CN | 1223489 | 7/1999 |
| CN | 1412897 | 4/2003 |
| CN | 1559094 | 12/2004 |
| CN | 202308403 | 7/2012 |
| CN | 103066418 | 4/2013 |
| TW | 336603 M | 7/2008 |

* cited by examiner

*Primary Examiner* — Hae Moon Hyeon

(74) *Attorney, Agent, or Firm* — Ming Chieh Chang; Wei Te Chung

(57) ABSTRACT

A coaxial connector (100), includes an insulative housing (1), a static terminal (3) and a movable terminal (4). The static terminal (3) has a first contacting portion (33) and a leading plate (34) extending upwardly therefrom. The movable terminal (4), formed by a stainless steel plate, includes a second contacting portion (44) and a reacting portion (43). Due to the guidance of the leading plate (34), the second contacting portion (44) resists under the first contacting portion (33). The reacting portion (43) drives the second contacting portion (44) downward to leave the first contacting portion (33), when the testing probe poked. Nickel-plated layers (43*b*) are disposed on the surfaces of the stainless steel plate (43*a*) and gold-plated layers (43*c*) are disposed on the nickel-plated layers (43*b*) so that the movable terminal (4) has an overall thickness in the range from about 62.1 μm to about 73.2 μm.

10 Claims, 7 Drawing Sheets

COAXIAL CONNECTOR HAVING A STATIC TERMINAL AND A MOVABLE TERMINAL

BACKGROUND OF THE INVENTION

1. Field of the Invention

The present invention relates generally to a coaxial connector, and more particularly to a coaxial connector having a static terminal and a movable terminal.

2. Description of Related Arts

A coaxial connector is widely used in an electronic appliance for denoting multi positions when the electronic appliance is in use. Patent No. TWM336603 discloses a conventional coaxial connector. The coaxial connector includes an insulative housing, a movable contact, a fixed contact and a shell. The movable contact and the fixed contact are located in the insulative housing. The insulative housing is divided into an insulative cover and an insulative base which together define a cavity. The movable contact has a connecting portion and an elastic portion extending from the connecting portion. The fixed contact has a fixed portion located in the insulative housing, a curved portion extending from the fixed portion along a vertical direction and a contacting portion extending from the fixed portion along a horizontal direction. The elastic portion is engaged with the contacting portion in a normal state. U.S. Pat. No. 6,554,630 discloses another conventional coaxial connector. The coaxial connector includes an insulating case made from a synthetic resin, a metallic fixed terminal and a movable terminal. The insulating case is divided into a lower insulating case and an upper insulating case. The movable terminal is formed by punching a stainless steel plate made of SUS 301 having a spring property so as to have a predetermined shape. Then, on surfaces of the stainless steel (SUS 301), nickel plating films are formed and on the nickel plating films, gold is further plated so that the movable terminal has an overall thickness in the range of from about 45 μm to about 62 μm.

Due to the fixed contact being designed in a level plane, there is something wrong for the contact between the movable contact and the fixed contact when the movable contact is assembled to the insulative housing. As a result, it is impossible for the movable contact and the fixed contact completing correct contact to prevent a failure to the electric contact function. it is much possible to increase the costs, if the movable contact is inserted obliquely into the insulative housing firstly. In addition, in accordance with recent advances in miniaturization of the coaxial connector and reduction of the height and overall size thereof, miniaturizing of the movable terminal is also required, so that the size of a movable spring portion and the thickness of the movable terminal have to be reduced. In a cantilever structure, in order to have a required contact-point pressure between the movable terminal and the fixed terminal, the thickness of the material must be comparatively large. Also, in the cantilever structure, in order to prevent connector deficiencies caused by plastic deformation of the lever, the entire length of the lever must be large. Therefore, the miniaturization of the movable terminal is prevented which therefore prevents miniaturization of the connector itself. In general, it brings about series of problems of manufacturing difficulty if the movable terminal is made too thin.

An improved coaxial connector having a static contact with guiding function is desired.

SUMMARY OF THE INVENTION

Accordingly, an object of the present invention is to provide a coaxial connector having a movable contact and a static terminal.

To achieve the above object, A coaxial connector, cooperated with a testing probe or plug, comprising: an insulative housing; a static terminal received in the receiving room, comprising a first affixed portion seated in the insulative housing, a first contacting portion and a first soldering portion extending oppositely from the first affixed portion, said first contacting portion having an upwardly inclining leading plate formed in a free end of the first contacting portion; and a movable terminal received in the receiving room, comprising a reacting portion, a second affixed portion, a second soldering portion, and a second contacting portion mounted below the first contacting portion through a guidance by the leading plate and resisting against the first contacting portion, said reacting portion driven downwardly to separate the second contacting portion from the first contacting portion when the testing probe is inserted.

A coaxial connector, cooperated with a testing probe, comprising: an insulative housing, defining a receiving room; a first terminal received in the receiving room; and a second terminal received in the receiving room and formed by punching a stainless steel plate, comprising a second soldering portion, a second fixed portion, a second contacting portion resisting against the first contacting portion and a reacting portion connecting the second fixed portion with the second contacting portion, nickel-plated layers disposed on the upper and lower surfaces of the stainless steel plate, gold-plated layers disposed on the nickel-plated layers and the movable terminal accordingly having an overall thickness in the range from about 62.1 μm to about 73.2 μm.

Other objects, advantages and novel features of the invention will become more apparent from the following detailed description when taken in conjunction with the accompanying drawings.

DETAILED DESCRIPTION OF THE PREFERRED EMBODIMENT

Figure 1:
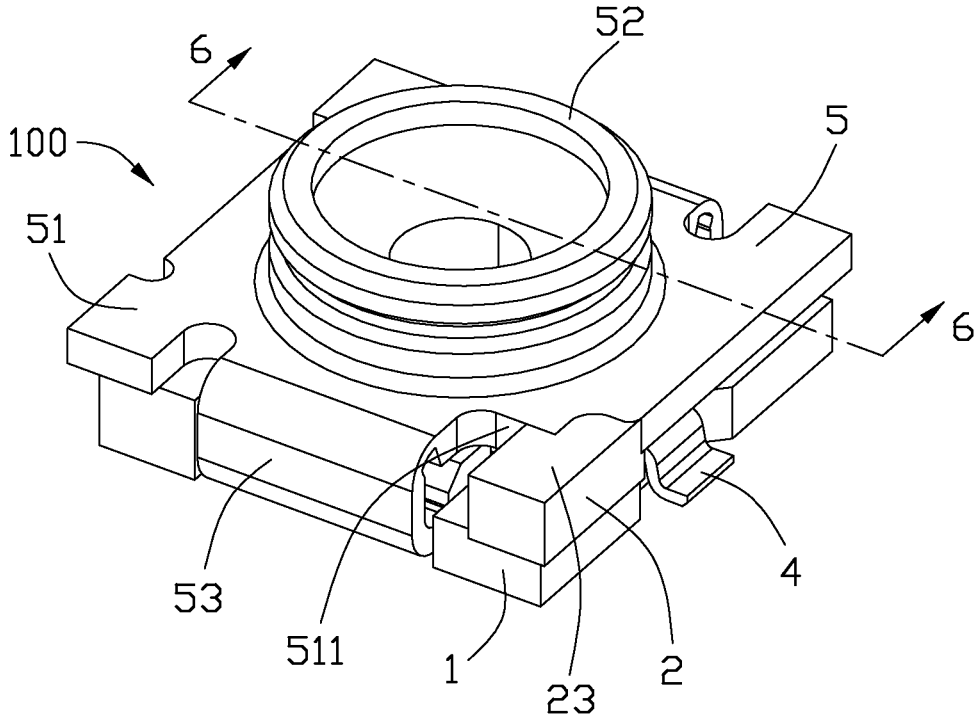
FIG. 1 is a perspective, assembled view of a coaxial connector of the present invention.
Figure 2:
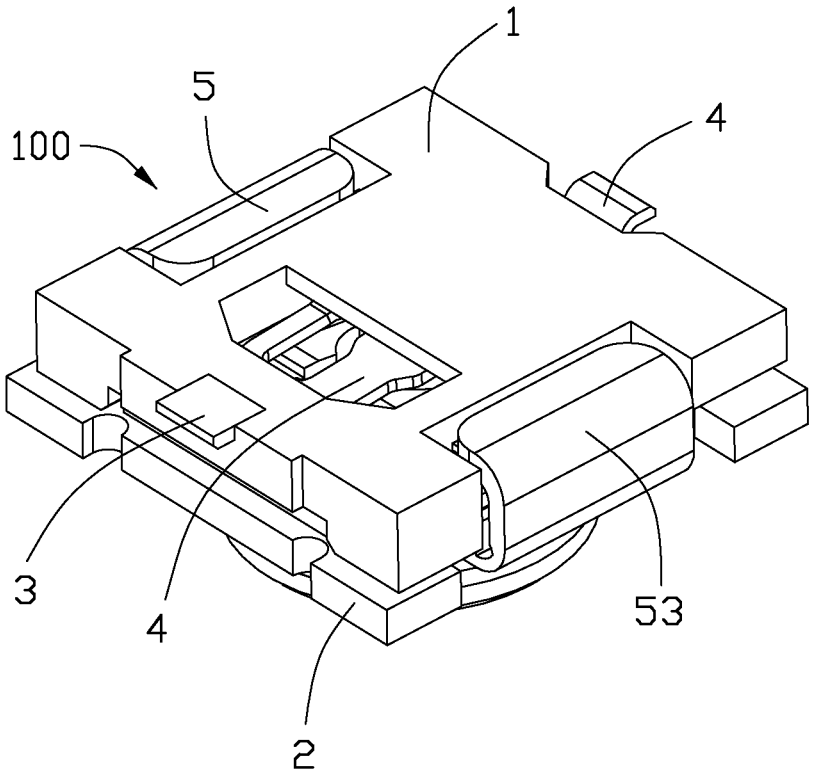
FIG. 2 is another perspective, assembled view similar to FIG. 1, taken from another aspect.

Reference will now be made in detail to the preferred embodiment of the present invention.

Referring to FIGS. 1 to 7, a coaxial connector 100 of the present invention comprises an insulative housing 1, an insulative cap 2 attached to the insulative housing 1, a static terminal 3 and a movable terminal 4 received in the insulative housing 1 and a metal shell 5 covering the insulative housing 1 and the insulative cap 2.

Figure 3:
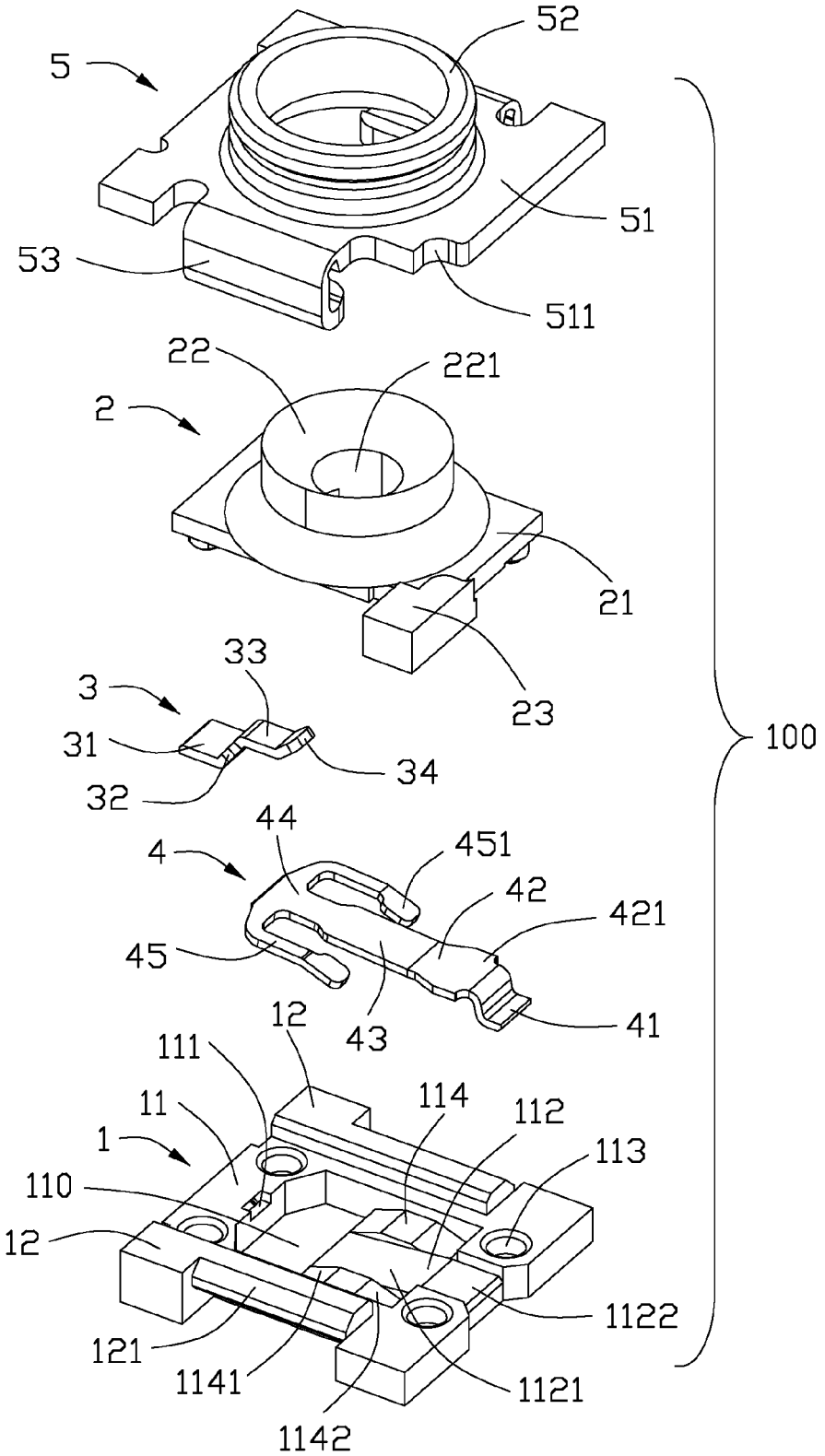
FIG. 3 is an exploded view of a coaxial connector of the present invention.
Figure 4:
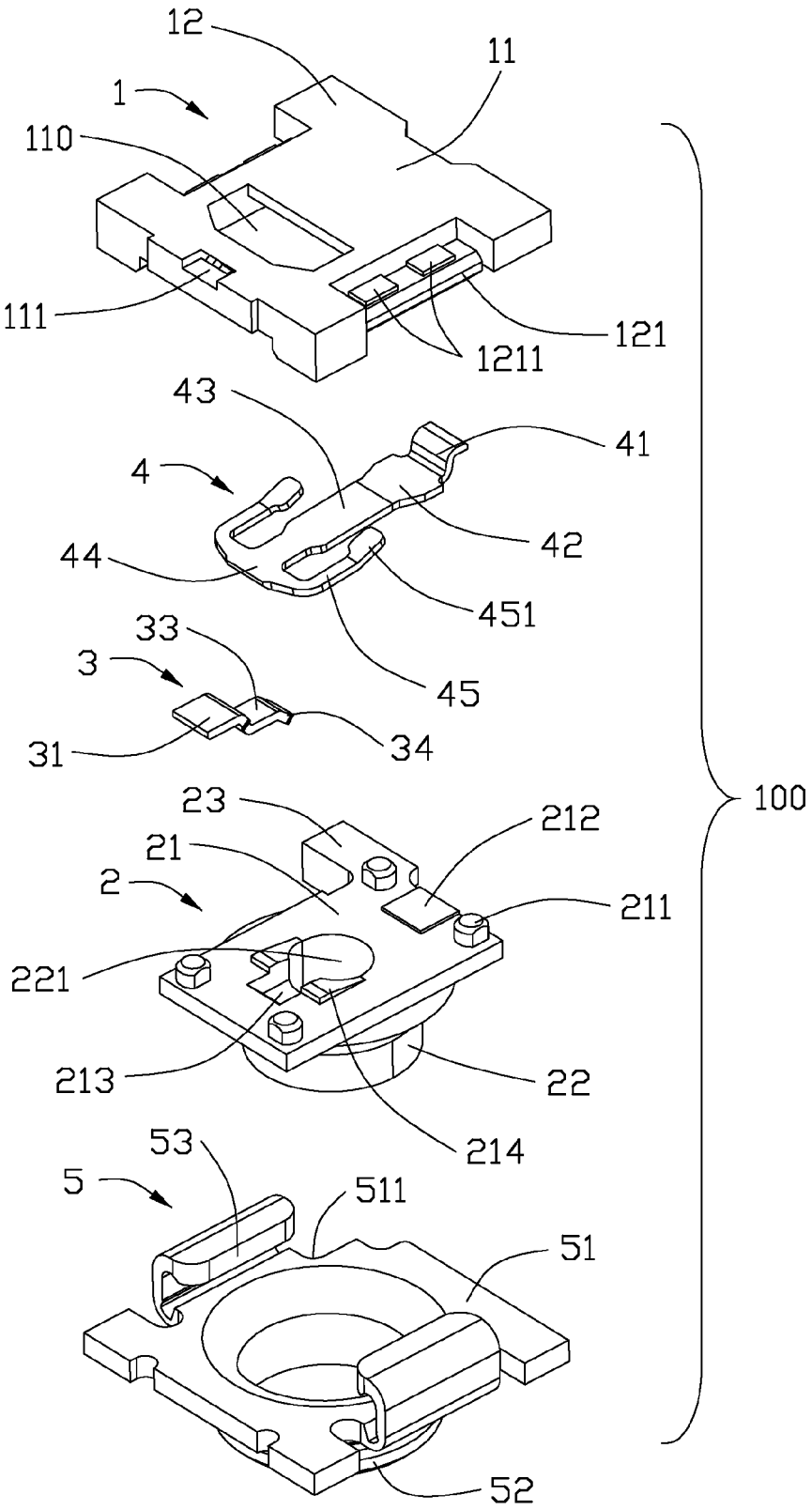
FIG. 4 is another exploded view similar to FIG. 3, taken from another aspect.

Referring to FIGS. 3-4, the insulative housing 1 includes a base portion 11 and a pair of side portions 12 extending upwardly from two sides of the base portion 11 forming a receiving room 110 therebetween. The receiving room 110 is not only used to receive the static terminal 3 and the movable terminal 4, but also provides enough space for elastic deformation of the movable terminal 4. The insulative housing 1 defines a first contact-receiving slot 111, a second contact-receiving slot 112, a plurality of affixed holes 113 extending through the base portion 11 along a vertical direction, and a pair of supporting portions 114. The first contact-receiving slot 111 and the second contact-receiving slot 112 are located in two peripheries of the receiving room 110. An inclined plane 1121 is disposed below the second contact-receiving slot 112. The inclined plane 1121 extends into the receiving room 110 and the second contact-receiving slot 112 includes a flat groove 1122. The supporting portions 114 are ladder-shaped and located in two sides of the inclined plane 1121. Each supporting portion 114 includes a guiding platform 1141 and an oblique platform 1142. Each side portion 12 forms a grabbing block 121 and a plurality of gaskets 1211 protruding from a bottom of each grabbing block 121. The gaskets 1211 are used to enhance interference to ensure stable cooperation between the metal shell 5 and the insulative housing 1.

The insulative cap 2 includes a base body 21, a mating portion 22 extending upwardly from a middle of the base body 21, a confirming block 23 formed laterally from the base body 21 and a plurality of afstatic contacts 211 protruding downwardly from four corners of the base body 21. Each afstatic contact 211 is cooperated with the mating affixed hole 113 to make the insulative housing 1 and the insulative cap 2 connected firmly. The mating portion 22 is formed with a mating hole 221 through the base body 21 provided for testing probe's insert. The insulative cap 2 also has a pressing portion 212 located between two of the afstatic contacts 211 beside the confirming block 23. The pressing portion 212 is engaged with the flat groove 1122 to fix the movable terminal 4. The base body 21 has a containing cavity 213 forming a plurality of protrusions 214 along an edge of the mating hole 221. The static terminal 3 is sandwiched between the protrusions 214.

Referring to FIGS. 3-6, the static terminal 3, stamped by metal sheet and integrated with the insulative housing 1, is ladder-shaped and formed with a first soldering portion 31, a first affixed portion 32 extending upwardly from the first soldering portion 31, a first contacting portion 33 extending horizontally from the first affixed portion 32 and a leading/guiding plate 34 inclining upwardly. The leading plate 34 is received in the containing cavity 213 and the first contacting portion 33 contacts with the movable terminal 4 electrically.

The movable terminal 4, stamped by metal sheet, defines a second soldering portion 41, a second affixed portion 42 located in the flat groove 1122 after assembly, a reacting portion or spring arm 43 extending from the second affixed portion 42 along an installing direction for contact with the testing probe, a second contacting portion 44 extending from the reacting portion 43 along a direction perpendicular to the installing direction and a pair of cantilevers 45 bent reversely from two edges of the second contacting portion 44. The second affixed portion 42, sandwiched between the base portion 11 and the pressing portion 212, defines a plurality of fins 421 extending laterally from both sides to be stuck in the flat groove 1122. The second contacting portion 44 contacts with the first contacting portion 33 normally. The reacting portion 43 is located below the mating hole 221 and inclines downwardly, thus the second contacting portion 44 is seated at a first position lower than the second affixed portion 42. The cantilevers 45, located both sides of the reacting portion 43, forms a pair of lapping portion 451 inclining downwardly. The lapping portions 451 are arranged in the guiding platforms 1141 and seated at a second position higher than the first position.

Figure 7:
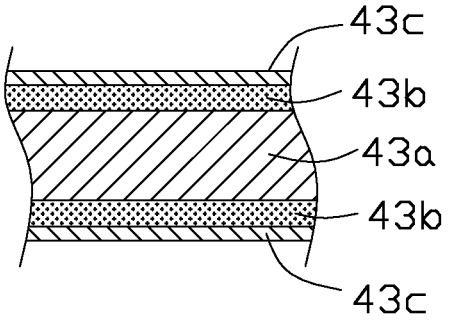
FIG. 7 is a diagram of the reacting portion of the movable terminal.

The movable terminal 4 is preferably formed by punching an SUS 301 stainless steel plate 43*a* having a spring property so as to have a predetermined shape. Then, as shown in FIG. 7, nickel-plated layers 43*b* are disposed on the upper and lower surfaces of the stainless steel plate 43*a*, and moreover, gold-plated layers 43*c* are disposed on the nickel-plated layers 43*b* so that the movable terminal 4 accordingly has an overall thickness in the range from about 62.1 μm to about 73.2 μm. Respectively, the thickness of the stainless steel plate 43*a* is 60±3 μm, while the thickness of the nickel-plated layers 43*b* is between about 2.5 μm and about 5 μm and the thickness of the gold-plated layers 43*c* is between about 0.05 μm and about 0.10 μm. The maximal thickness of the movable terminal 4 is defined as A μm and the minimal thickness of the movable terminal 4 is defined as B μm. The computational formulas are shown as follows: $A=60+3+(5+0.10)\times 2$, $B=60-3+(2.5+0.05)\times 2$. Young's moduli of the stainless steel (SUS 301) and nickel are approximately 200 Gpa respectively, and the Young's modulus of gold is about 80 Gpa. Therefore, the Young's modulus of gold is sufficiently smaller compared to those of the stainless steel (SUS 301) and nickel, and furthermore, since the thickness of the gold-plated layers 43*c* ranges approximately from 0.05 μm to 0.10 μm, the influence of the gold-plated layers 43*c* on the spring characteristics of the movable terminal 4 and an increase in the thickness of the movable terminal 4 are negligible.

As is known to all, the spring constant of the movable terminal 4 is supposedly fixed. Furthermore, the deterioration in the spring constant could not be recognized even on thousands of cycles of displacements of the movable terminal 4. When the mating coaxial connector is not attached thereto, the movable terminal 4 abuts the static terminal 3 and the pushing load therebetween exceeds the stable pushing load that is required to maintain a stable contact connection. The movable terminal 4 is preferably provided with the reacting portion 43 made from SUS 301 stainless steel and having a beam supported at both ends enabling a spring force larger than that of a conventional device to be obtained. Moreover, even when the thickness of the SUS 301 stainless steel varies, by plating the stainless steel with nickel having a Young's modulus that is similar to that of the SUS 301 stainless steel, changes in the spring force due to differences in the thickness of the SUS 301 stainless steel of the reacting portion 43 are compensated for.

When the thickness of the movable terminal 4 is below about 45 μm, the spring force is too small so that the pushing load is lower than the stable pushing load. When the thickness of the movable terminal 4 is greater than approximately 73.2 μm, the spring force is too large so that problems may arise, such that when the mating coaxial connector is attached, contacts of the static terminal 3 and the movable terminal 4 cannot be separated therefrom, and so forth. The convenient installing method contributes to cutting costs and saving time.

Referring to FIGS. 1-5, the metal shell 5 includes a cover 51, a tubular portion 52 extending upwardly from the middle of the cover 51 and a pair of clapping arms 53 bent from the both sides of the cover 51 and extending downwardly. The cover 51 has a gap 511 cooperated with the confirming block 23 to achieve fool-proofing and confirming function. The tubular portion 52 is used for receiving the mating portion 22 and the cover 51 overlaps the base body 21 The clapping arms buckle the grabbing blocks to realize the stable fasten between the metal shell 5, insulative cap 2 and the insulative housing 1.

Figure 5:
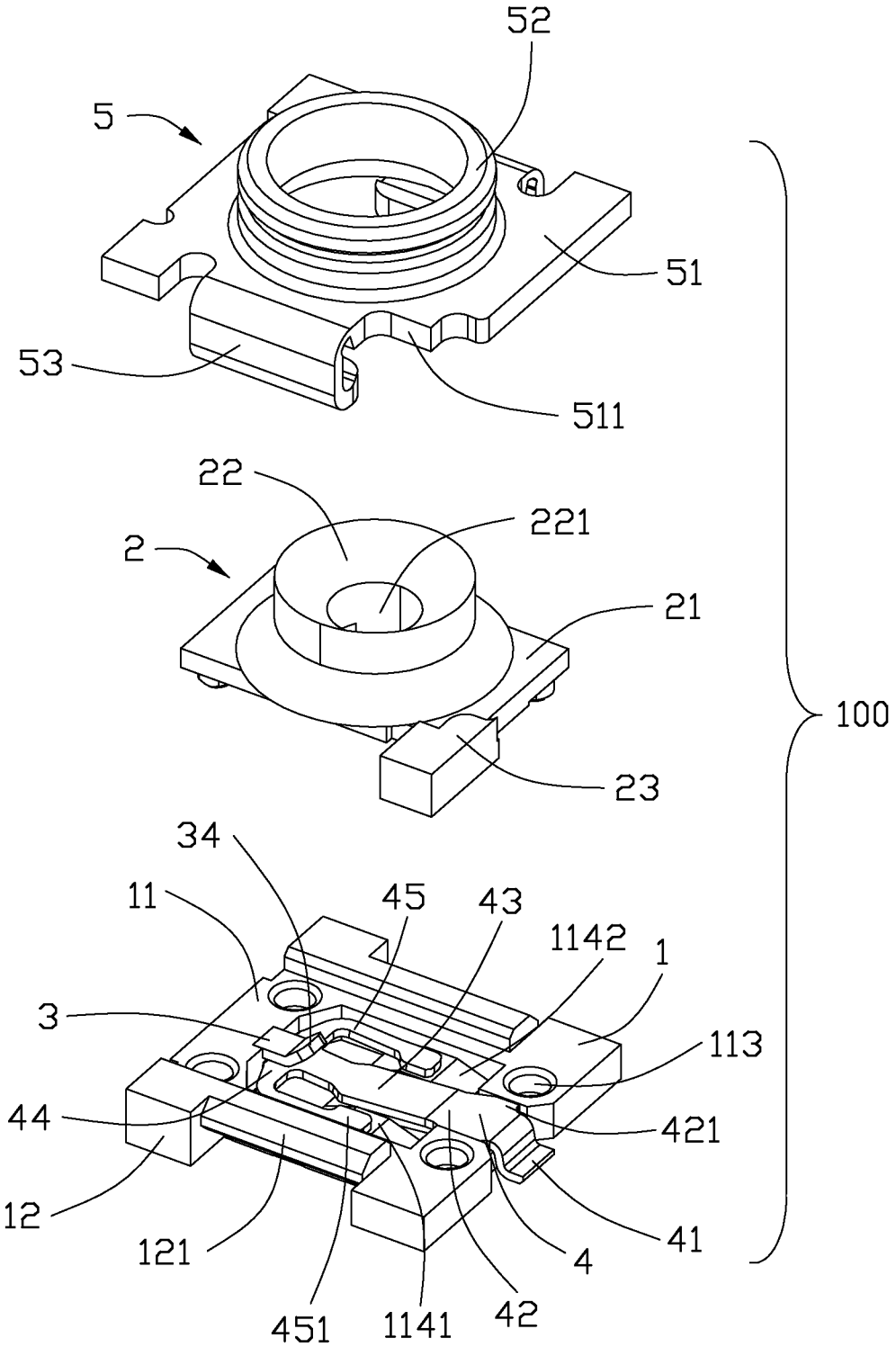
FIG. 5 is an exploded view showing the insulative cap and the metal shell separated from the insulative housing, the movable terminal and the static terminal.
Figure 6:
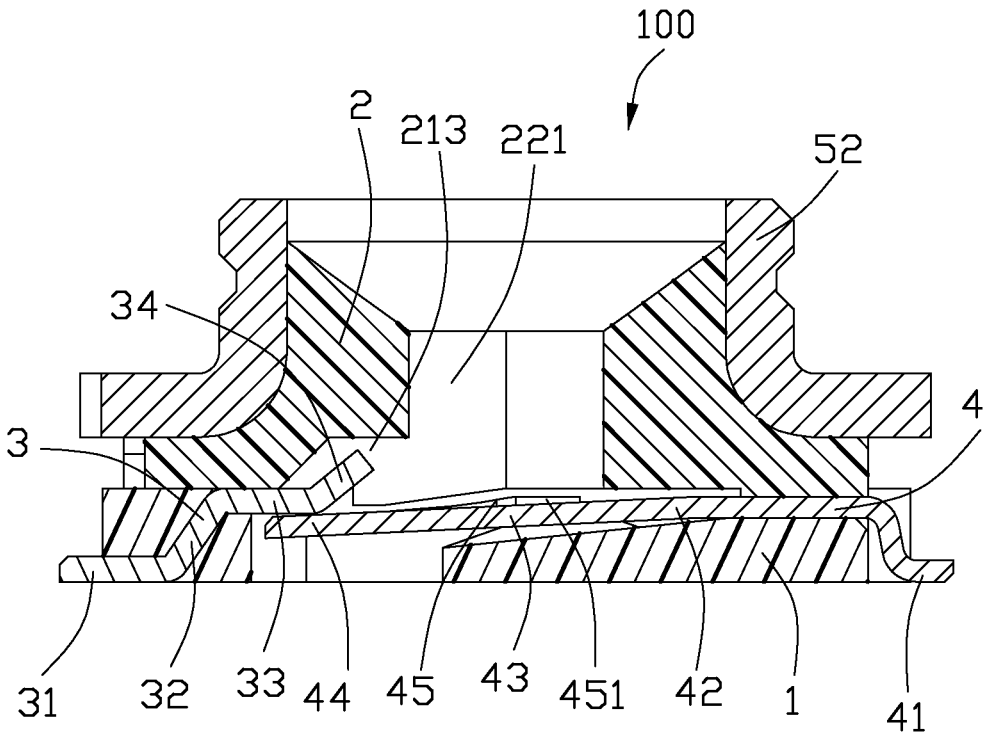
FIG. 6 is a cross-sectional view of the coaxial connector taken from line 6-6 in FIG. 1.

In this embodiment, the static terminal 3 is integrated with the insulative housing 1 at first. Then the movable terminal 4 is assembled in the second contact-receiving slot 112 from right to left in the horizontal level. As the upturned leading plate 34, the movable terminal 4 is inserted under the first contacting portion 33. The insulative cap 2 is compacted to the insulative housing 1 so that the afstatic contacts 211 are stuck into the affixed holes 113 and the pressing portion 212 confirms the second affixed portion 42 with the flat groove 1122. As shown in FIG. 5, the lapping portions 451 are located in the oblique platform 1142 before the insulative cap 2 assembled, while the lapping portions 451 are seated in the guiding platform 1141 and the second contacting portion 44 contacts with the first contacting portion 33 after the insulative cap 2 is assembled. When the testing probe is poked into the mating hole 221, the reacting portion 43 is driven downwardly to separate the second contacting portion 44 from the first contacting portion 33.

Due to the guidance of the leading plate 34 formed in a free end of the first contacting portion 33, it is easy for the second contacting portion 44 to resist under the first contacting portion 33 when assembly along a horizontal direction. The convenient installing method contributes to cutting costs and saving time.

One feature of the invention is to properly configure the moveable terminal 4 to be downwardly assembled into the hosing 1 initially in a vertical direction to reach an intermediate position, and successively, via assistance of the guiding plate 34, to horizontally move the moveable terminal 4 from the intermediate position to the final position where first contacting portion 33 downwardly abuts against the second contacting section 44. Notably, this horizontal movement of the moveable terminal 4 may be done after the cap 2 has been assembled to the housing 1

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A coaxial connector, cooperated with a testing probe, comprising:

an insulative housing having a receiving room;

a static terminal received in the receiving room, the static terminal comprising a first affixed portion seated in the insulative housing, a first contacting portion, and a first soldering portion extending opposite to the first affixed portion, said first contacting portion having an upwardly inclining leading plate formed at a free end thereof; and a movable terminal received in the receiving room, the movable terminal comprising a reacting portion, a second affixed portion, a second soldering portion, and a second contacting portion, the second contacting portion being positioned below the first contacting portion by sliding along the leading plate to resist against the first contacting portion, said reacting portion driven downwardly to separate the second contacting portion from the first contacting portion when the testing probe is inserted, wherein said reacting portion extends along an installing direction and said second contacting portion extends along a direction perpendicular to the installing direction in a horizontal plane.

2. The coaxial connector as claimed in claim 1, wherein said movable terminal comprises a pair of cantilevers bent oppositely from both sides of the second contacting portion and extending along a direction reverse to the installing direction, and said cantilevers are seated in both sides of the reacting portion.

3. The coaxial connector as claimed in claim 2, wherein said insulative housing has two guiding platforms, two free ends of the cantilevers are formed with a pair of lapping portions, and said lapping portions are located in the guiding platforms.

4. The coaxial connector as claimed in claim 3, wherein said reacting portion inclines downwardly from the second affixed portion, the second contacting portion is lower than the second affixed portion at a first position and the lapping portions are seated in the guiding platform at a second position higher than the first position.

5. The coaxial connector as claimed in claim 1, further comprising an insulative cap, and said static terminal is integrated with the insulative housing while the movable terminal is assembled and sandwiched between the insulative housing and the insulative cap.

6. The coaxial connector as claimed in claim 5, wherein the bottom of said insulative cap defines a containing cavity to receive the leading plate.

7. A coaxial connector for use with a plug, comprising:

an insulative housing defining a receiving room;

an insulative cap downwardly mounted upon the housing in a vertical direction and defining a mating hole downwardly communicating with the receiving room;

a static terminal secured to the housing and forming a static contacting section in the receiving room;

a movable terminal defining a movable contacting section for coupling to the static contacting section, said movable contact configured to be allowed to be downwardly assembled to the housing initially along said vertical direction to reach an intermediate position, and successively along a horizontal direction perpendicular to the vertical direction to reach a final position; wherein the static terminal further defines an upward guiding plate around the static contacting section to confront the movable terminal so as to downwardly deflect the movable terminal when the movable terminal is moved from the intermediate position to the final position where the static contacting section and the movable contacting section are electrically and mechanically connected to each other in the vertical direction when no plug is inserted into the mating hole and the receiving room while the static section and the movable contacting section are separated from each other when the plug is inserted into the mating hole and the receiving room to downwardly push the movable contacting section away from the static contacting section;

the movable terminal includes a spring arm linked with the movable contacting section, and said spring arm extends in a downward oblique direction when the movable terminal is located at the final position; and the movable terminal includes a cantilever with a lapping portion at a front end to support the spring arm, and said lapping portion is essentially horizontally positioned along said horizontal direction to downwardly abut against a horizontal platform of the housing when said movable terminal is located at the final position.

8. The electrical connector as claimed in claim 7, wherein said housing is further equipped with a slanted platform beside the horizontal platform to receive the lapping portion when said movable terminal is located at the intermediate position.

9. The electrical connector as claimed in claim 7, wherein said lapping portion is angled with regard to the cantilever.

10. The electrical connector as claimed in claim 7, wherein said movable terminal further includes an affixing section behind the spring arm to secure the movable terminal to the housing, and said affixing section is sandwiched between the housing and the cap in the vertical direction.

* * * * *